US006789626B2

(12) United States Patent
Wagg

(10) Patent No.: US 6,789,626 B2
(45) Date of Patent: Sep. 14, 2004

(54) APPARATUS AND METHOD FOR CLEANING DEBRIS FROM WELLS

(75) Inventor: Brian Wagg, Edmonton (CA)

(73) Assignee: C-Fer Technologies (1999) Inc., Edmonton (CA)

( * ) Notice: Subject to any disclaimer, the term of this patent is extended or adjusted under 35 U.S.C. 154(b) by 253 days.

(21) Appl. No.: 09/912,349

(22) Filed: Jul. 26, 2001

(65) Prior Publication Data

US 2002/0020532 A1 Feb. 21, 2002

(30) Foreign Application Priority Data

Aug. 11, 2000 (CA) ..... 2315669

(51) Int. Cl.[7] ..... E21B 37/00; E21B 34/00
(52) U.S. Cl. ..... 166/312; 166/325
(58) Field of Search ..... 166/325, 312, 166/311, 372, 373, 106

(56) References Cited

U.S. PATENT DOCUMENTS

| | | | | | |
|---|---|---|---|---|---|
| 2,798,558 | A | * | 7/1957 | McCulloch | 166/114 |
| 2,918,973 | A | | 12/1959 | Ozinga | 166/171 |
| 2,946,565 | A | * | 7/1960 | Williams | 166/106 |
| 3,268,004 | A | * | 8/1966 | Kiel | 166/106 |
| 3,381,755 | A | | 5/1968 | Morrison | 166/191 |
| 3,572,431 | A | | 3/1971 | Hammon | 166/99 |
| 3,605,886 | A | | 9/1971 | Cox et al. | 166/89 |
| 3,760,878 | A | | 9/1973 | Peevey | 166/185 |
| 3,822,750 | A | | 7/1974 | Ping | 166/309 |
| 4,267,888 | A | | 5/1981 | Singer | 166/312 |
| 4,392,529 | A | | 7/1983 | Burwell | 166/255 |
| 4,393,927 | A | | 7/1983 | Singer | 166/105 |
| 4,574,894 | A | | 3/1986 | Jadwin | 175/317 |
| 4,671,359 | A | | 6/1987 | Renfro | 166/312 |
| 4,681,167 | A | | 7/1987 | Soderberg | 166/371 |
| 4,744,420 | A | * | 5/1988 | Patterson et al. | 166/105 |
| RE32,866 | E | | 2/1989 | Cruise | 166/310 |
| 4,921,577 | A | | 5/1990 | Eubank | 166/311 |
| 4,944,349 | A | | 7/1990 | Von Gonten, Jr. | 166/311 |
| 4,955,462 | A | | 9/1990 | Bilodeau et al. | 193/37 |
| 5,033,545 | A | | 7/1991 | Sudol | 166/312 |
| 5,247,990 | A | * | 9/1993 | Sudol et al. | 166/106 |
| 5,318,128 | A | * | 6/1994 | Johnson et al. | 166/312 |
| 5,924,490 | A | | 7/1999 | Stone | 166/312 |
| 6,341,652 | B1 | * | 1/2002 | Malone et al. | 166/312 |
| 6,371,206 | B1 | * | 4/2002 | Mills | 166/312 |
| 2002/0153142 | A1 | * | 10/2002 | Eslinger et al. | 166/305.1 |

* cited by examiner

*Primary Examiner*—Lynne H. Browne
*Assistant Examiner*—Kenneth Thompson
(74) *Attorney, Agent, or Firm*—Anthony R. Lambert

(57) ABSTRACT

A system and method for restarting a downhole pump that has seized due to an accumulation of debris above the pump and around the pump intake. The system consists of a flexible annulus sealing element fitted on a joint of production tubing where the annulus seal can be activated by pumping fluid down the well annulus from surface. The tool includes tubing and check valve arrangements such that fluid from the well annulus above the flexible annulus sealing element can enter the production tubing immediately above the downhole pump and circulate debris back to surface as well as introduce fluid to the pump intake to mobilize debris accumulated at the pump intake.

21 Claims, 2 Drawing Sheets

APPARATUS AND METHOD FOR CLEANING DEBRIS FROM WELLS

BACKGROUND OF THE INVENTION

The present invention relates to a method and system for removing debris from a well where the debris has accumulated both above the downhole pump and at the downhole pump intake. In particular, it relates to a downhole tool that isolates the perforations and allows the debris to be circulated to surface without requiring a special tubing string to be run from surface.

One application for this invention is in the production of heavy oil from subsurface reservoirs where current operating practices encourage the co-production of reservoir sand with reservoir fluids. This sand can accumulate in the well annulus to impair flow to the downhole pump intake and accumulate in the production tubing above the pump, thereby impairing, and in many cases, halting pump operation. Consequently, sand clean-outs typically account for more than half of well servicing activity in heavy oil operations.

Conventional well servicing techniques require all of the downhole equipment to be pulled from the well prior to running in a sand bailer of some design. This requires a workover rig and often several days of bailing to get the well clean enough to re-install the downhole pump. This invention describes a new method and system that allows sanded in downhole pumps to be restarted without pulling them from the well.

Another method that is currently used for cleaning out wells is to load the well annulus with fluid from surface, which flushes the sand from the wellbore back into the formation through the perforations. This may effectively remove sand from the wellbore near the top of the perforated interval, but since the pump intake is typically located below the perforations, loading the annulus will likely not mobilize any sand accumulated around the pump intake.

This method also does not mobilize sand accumulations in the production tubing above the downhole pump.

For downhole pumps driven by sucker rods, sand accumulated above the pump can seize the rod string in the production tubing, thereby preventing the pump from being restarted even if the pump intake is clear. The debris accumulated in the tubing must be removed to allow the pump to be restarted. This debris could be mobilized and circulated to surface by injecting fluid into the production tubing just above the downhole pump. It is, however, not practical to install an injection tubing string from surface for this purpose due to the expense of the tubing and the added rig time and aggravation caused by strapping the injection tubing to the production tubing during installation of the downhole equipment.

SUMMARY OF THE INVENTION

This invention describes a new method and system that allows downhole pumps that are clogged with sand or other debris, here generally referred to as "debris", to be restarted without pulling them from the well.

According to one aspect of the invention, the invention provides a method based on circulating debris out of the wellbore using the installed downhole pump instead of removing the downhole pump and bailing debris from the well. This is accomplished by mobilizing the debris in the production tubing above the downhole pump and at the downhole pump intake, then restarting it. Debris is mobilized by introducing fluid into the debris pack in both the well annulus and the production tubing above the downhole pump.

In another aspect of the invention, a tube is inserted near the downhole pump intake so that fluid can be pumped directly to the pump intake so that the debris can be mobilized.

In another aspect of the invention, there is provided a system that allows fluid to be circulated down the well annulus, through a port in the production tubing immediately above the downhole pump and back to surface. This allows debris to be circulated out of the well to surface prior to restarting the pump. The port in the production tubing, is configured with a check valve to prevent fluid loss during normal pumping operations.

To circulate the debris accumulated in the production tubing to surface may require a downhole pressure applied to the annulus that is significantly higher than the reservoir pressure. Therefore, to prevent the injected fluid from entering the reservoir, the perforations must be isolated from the well annulus above the downhole pump. It is thus proposed in accordance with another aspect of the invention, that a flexible sealing element be installed, preferably approximately one joint above the downhole pump.

Therefore, in accordance with an aspect of the invention, there is provided an apparatus for cleaning debris from wells, the apparatus comprising a tubular tool body having connection ends for installation in a production tubing string, the tubular tool body having an exterior and interior and one end of the tubular tool body being an upper end; and a flexible annulus sealing element disposed around the tubular tool body.

In accordance with another aspect of the invention, the flexible annulus seal allows the upward flow of formation gas during normal pump operation but forms a seal in the annulus when fluid is pumped into the well annulus from surface.

In accordance with another aspect of the invention, there is provided at least one bypass tubing defining a flow passageway from the exterior of the tubular tool body above the flexible annulus sealing element to the interior of the tubular tool body at some location or locations above the downhole pump.

In accordance with another aspect of the invention, there is provided at least one bypass tubing defining a flow passageway from the exterior of the tubular tool body above the flexible annulus sealing element to the exterior of the tubular tool body below the flexible annulus sealing element and continuing to near the pump intake.

In accordance with another aspect of the invention, each bypass tubing may be configured with a check valve to control flow during different stages of the well cleanout operation. The check valve may be pressure sensitive so that it closes at one threshold pressure and opens again once the pressure falls below that threshold. The threshold pressure, where the check valve closes, would be selected to correspond to slightly above the hydrostatic pressure that occurs when the well annulus is filled with the work over fluid.

In accordance with another aspect of the invention, there may be provided centralizers disposed around the tubular tool body to protect the flexible annulus sealing element.

In accordance with a further aspect of the invention, there is provided a method of cleaning debris from a wellbore, in which the wellbore contains production tubing and a pump having a pump intake, the wellbore and exterior of the production tubing defining an annulus, the method comprising the steps of: sealing the annulus above the downhole pump by pumping fluid into the wellbore annulus from surface to activate a flexible annulus sealing element to isolate the producing reservoir; and conducting the fluid from the annulus above the flexible annulus sealing element to a location in which debris has accumulated, as for example, adjacent the downhole pump intake or within the production tubing above the downhole pump, to thereby mobilize the debris and permit the debris to be removed.

In a further aspect of the method of the invention, there is provided the step of continuing to pump fluid from surface into the wellbore annulus to circulate the debris back to surface through the production tubing.

In a further aspect of the method of the invention, there is provided the step of starting the downhole pump to aid in circulating the debris to surface and to resume production of fluids from the reservoir.

In a further aspect of the method of the invention, there is provided the step of allowing the fluid in the well annulus above the flexible annulus sealing element to drain at a controlled rate to the pump intake to dilute further influxes of debris.

In a further aspect of the method of the invention, there is provided the step of relaxing the flexible annulus sealing element to allow the upward flow of formation gas in the well annulus during normal pump operation.

BRIEF DESCRIPTION OF THE DRAWINGS

There will now be described preferred embodiments of the invention, with reference to the figures for the purpose of illustration only, without intending to limit the scope of invention as defined by the claims, in which figures like numerals denote like elements, and in which:

DETAILED DESCRIPTION OF PREFERRED EMBODIMENTS

In this patent document, "comprising" is used in its inclusive sense, and does not exclude other elements being present in the device to which a claim refers. Use of the indefinite article "a" before an element of a claim means that at least one of the elements is present.

Figure 1:
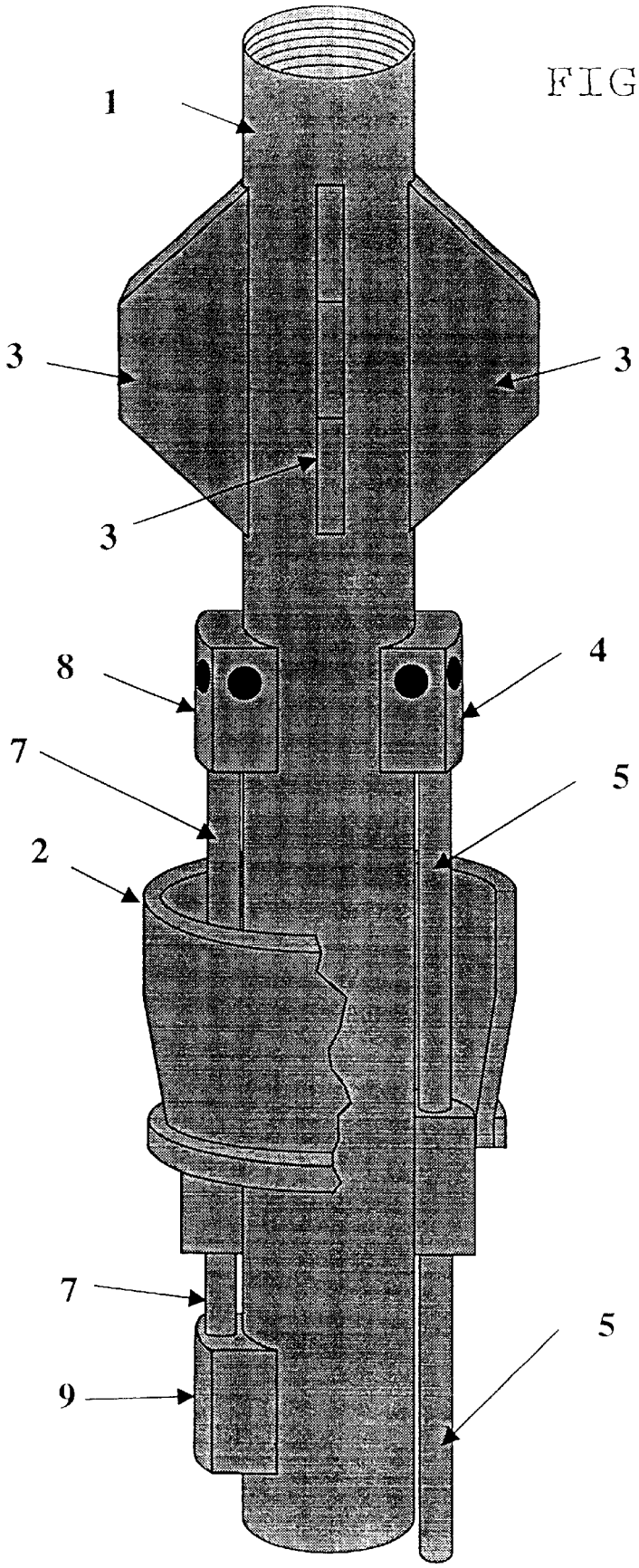
FIG. 1 is an isometric view of a toot according to the invention.

FIG. 1 shows details of the preferred tool configuration with the tubular tool body 1 with standard oilfield tubular connections at each end to mate with conventional production tubing, a flexible annulus sealing element 2, centralizing shoes 3, spring loaded checkvalve 4, tubing extending to the intake of the downhole pump 5, tubing 7 connecting the check valve 8 to a port 9 to introduce fluid into the production tubing above the downhole pump.

Figure 2:
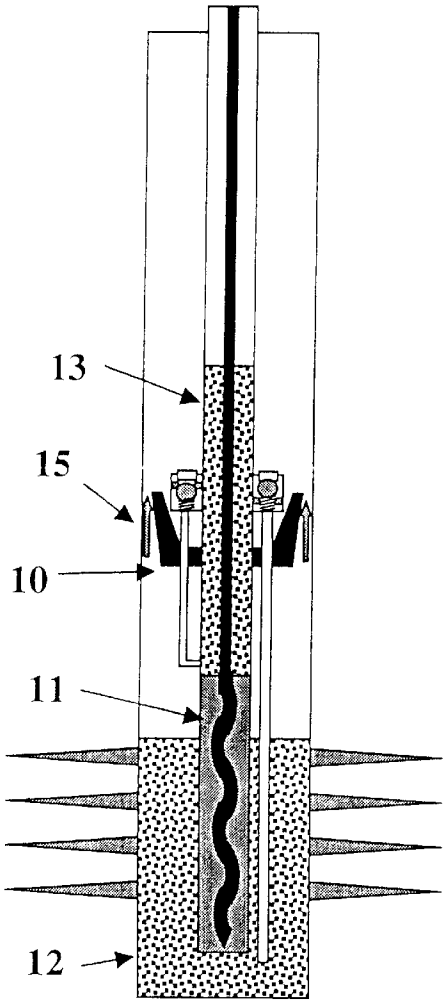
FIG. 2 is a section through a tool according to the invention in position in a well in which debris has filled a portion of the production tubing above the downhole pump and the well annulus to an elevation approximately level with the top of the perforated interval.

FIG. 2 shows the tool 10 installed in a producing well just above the downhole pump 11 with debris accumulated in the annulus 12 and above the pump 11. Gas 15 is free to flow past the tool up the well annulus.

Figure 3:
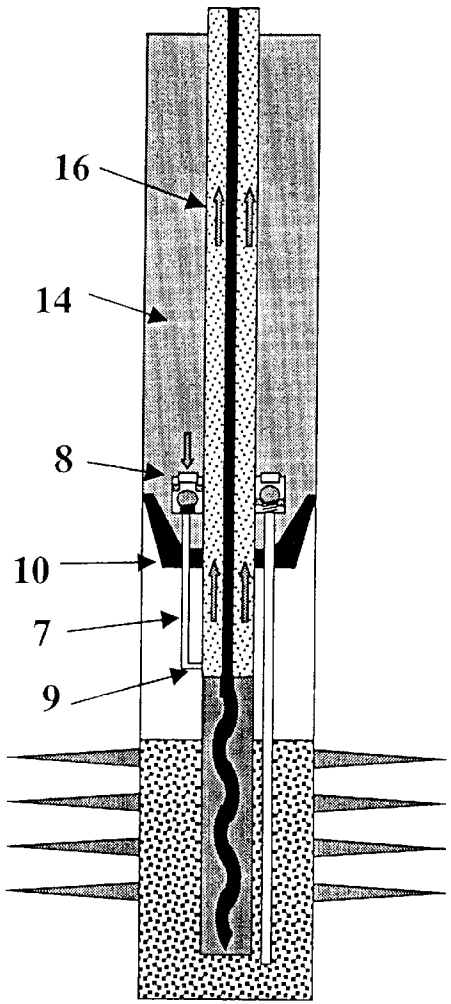
FIG. 3 is a section showing the tool of FIG. 1 in position for mobilizing debris in the production tubing above the downhole pump.

FIG. 3 shows the tool 10 activated by filling the well annulus with fluid 14 forcing check valve 8 open and circulating fluid through the port 9 in the production tubing 16 above the downhole pump and finally to surface.

Figure 4:
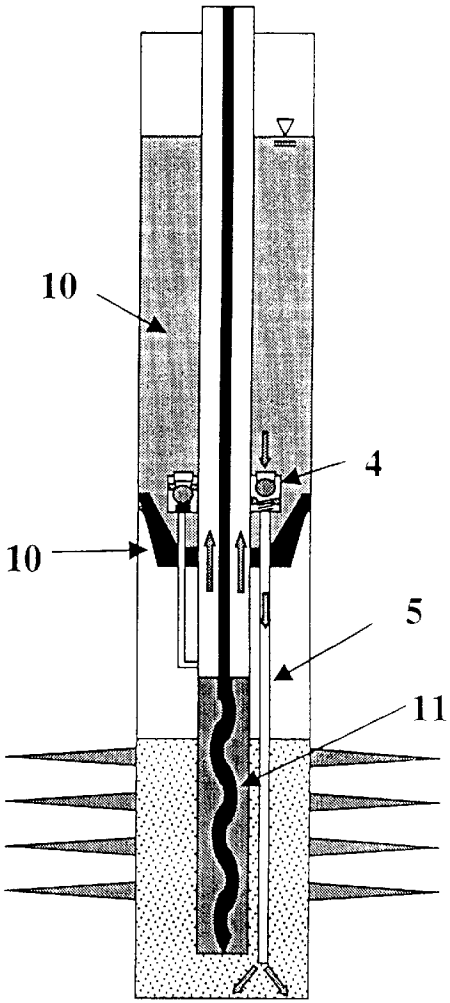
FIG. 4 is a section showing the tool of FIG. 1 in position for mobilizing debris around the pump intake and draining the fluid from the well annulus to dilute further influxes of debris.

FIG. 4 shows the tool 10 after the debris is circulated out of the production tubing 16 and no further fluid is pumped into the well annulus from surface, the spring loaded check valve 4 opens and drains fluid from the annulus 14 back to the intake of the downhole pump 11 through tube 5.

The downhole tool body 10 is mounted above the downhole pump 11 as an integral segment of the production tubing string 16. The flexible annulus sealing element 2 on the exterior of the tool 10 forms a seal in the annulus 12 between the production tubing 16 and production casing or liner 17 when fluid is pumped down the well annulus 14 from surface. Above the sealing element 2 are situated two check valves, or spring loaded check valves 4, 8 that are connected to small diameter tubing 5, 7 respectively. Tube 5 is attached to the exterior of the tool 10 and conducts the injected fluid to the pump intake 18. Tube 7 connects to port 9 in the production tubing 16 immediately above the downhole pump 11 and allows fluid and debris to be circulated to surface through the production tubing 16 prior to restarting the downhole pump 11.

The sealing element 2, installed on the exterior of a segment of production tubing 16, is normally relaxed, allowing venting of produced gas up the well annulus 14 but can be activated by flowing fluid down the well annulus 14. The sealing element 2 should be designed to withstand well annulus pressure equivalent to the sum of the total fluid head when the well is filled with fluid to surface plus the pressure required to mobilize debris in the production tubing and circulate fluid back to surface through the production tubing 16. The tubing and valve configuration prevents debris from plugging these components during normal pump operation. The centralizing shoes 3 are provided on the tool 10 to prevent damage to the sealing element 2 during installation and retrieval from the well. The valve and tubing configurations ensure that the majority of fluid circulates through the production tubing 16 to surface compared to the volume of fluid injected at the pump intake 18. It is preferred that the valve and tubing configuration is sized such that the fluid remaining in the well annulus above the tool following the clean-out procedure, can drain back to the operating fluid level in a specified length of time ranging from 1 to 24 hours.

The sealing element 2 is normally in a relaxed state allowing formation gas to rise, with minimal impediment, up the well annulus 14. When fluid is pumped down the well annulus 14, however, the flexible annulus sealing element 2 deforms and creates a seal with the casing 17 and allows pressure in the annulus 14 to be increased. The check valve 8 on the tubing just above the pump 11 opens once the annulus pressure exceeds the static head of fluid in the production tubing 16. Fluid then circulates down the annulus 14 and back up through the production tubing 16 carrying any debris with it.

Once the operator is satisfied that the debris has been sufficiently mobilized or circulated out of the production tubing 16, the pump 11 may be restarted. 33 In accordance with another aspect of the invention, the tube 5 is installed to introduce fluid at the pump intake 18, to liquefy the debris ready to be pumped to surface by the restarted downhole pump 11. The spring-loaded check valve 4 on the tube 5 closes when the annulus pressure reaches a preset limit (such as for example ~4 MPa) so that while pumping from surface the majority of fluid is circulated up the production tubing 16. When circulating ceases, this valve 4 opens and allows the fluid above the sealing element 2 to drain back to the pump intake 18. This draining fluid maintains the debris in suspension around the pump intake 18 as fluid and debris are pumped from the well by the downhole pump 11.

This tool 1 could also function as a continuous loading system for wells that are known to have debris accumulation problems. Many operators load problem wells on a daily basis by injecting small volumes of fluid into the well annulus 14 to dilute the debris content and to reduce the fluid viscosity. The annulus of a well 14 with the tool 10 may be filled periodically with the tool 10 supplying a continuous flow of the load fluid directly to the pump intake 18 by way of tube 5. This, however, would prevent gas venting 15 up the well annulus 14, making this system inappropriate for wells with high gas production.

The parts shown here are all made with conventional downhole materials. Immaterial changes may be made to the embodiments described here without departing from the essence of the invention.

I claim:

1. Apparatus for cleaning debris from wells, the apparatus comprising:

a tubular tool body having connection ends for installation in a production tubing string, the tubular tool body having an exterior and interior and one end of the tubular tool body being an upper end;

a flexible annulus sealing element disposed around the tubular tool body that may be activated by pumping fluid into the well annulus from surface; and a first bypass tubing defining a flow passageway from the exterior of the tubular tool body above the flexible annulus sealing element to the interior of the tubular tool body.

2. The apparatus of claim 1 further comprising centralizers disposed around the tubular tool body to protect the flexible annulus sealing element.

3. The apparatus of claim 1 in which the first bypass tubing incorporates a first check valve permitting flow only from the exterior of the tubular tool body to the interior of the tubular tool body.

4. The apparatus of claim 1 further comprising a second bypass tubing defining a flow passageway from the exterior of the tubular tool body above the flexible annulus sealing element to the exterior of the tubular tool body below the flexible annulus sealing element.

5. The apparatus of claim 4 in which the second bypass tubing incorporates a second check valve.

6. The apparatus of claim 5 in which the second check valve permits flow from above the flexible annulus sealing element to below the annulus sealing element only when pressure above the flexible annulus sealing element is below a pie-set limit.

7. Apparatus for cleaning debris from wells, the apparatus comprising:

a tubing string;

a tubular tool body having an upper end for connection into the tubing string and a lower connection end, the tubular tool body having an exterior and interior;

a pump disposed in the tubing string below the tubular tool body, the pump having a pump intake;

a flexible annulus scaling clement disposed around the tubular tool body that may be activated by pumping fluid into the well annulus from surface; and a first bypass tubing defining a flow passageway from the exterior of the tubular tool body above the flexible annulus sealing element to the exterior of the tubular tool body below the flexible annulus sealing element and adjacent to the pump intake.

8. The apparatus of claim 7 further comprising centralizers disposed around the tubular tool body to protect the flexible annul us sealing element.

9. The apparatus of claim 8 in which the first check valve permits flow from above the flexible annulus sealing element to below the annulus sealing element only when pressure above the flexible annulus sealing element is below a pre-set limit.

10. The apparatus of claim 1 further comprising a second bypass tubing defining a flow passageway from the exterior of the tubular tool body above the flexible annulus sealing element to the interior of the tubular tool body.

11. The apparatus of claim 10 in which the second bypass tubing incorporates a second check valve.

12. The apparatus of claim 11 in which the first bypass tubing incorporates a first check valve permitting flow only from the exterior of the tubular tool body to the interior of the tubular tool body.

13. A method of cleaning debris from a well bore, in which the well bore contains production tubing and a downhole pump having a pump intake, the well bore exterior of the production tubing defining an annulus, the method comprising the steps of:

providing an apparatus for cleaning debris from wells in the well bore, with a flexible annulus sealing element spaced from the production tubing to allow produced gas to bypass the apparatus;

sealing the annulus above the downhole pump by pumping fluid into the wellbore annulus from surface to activate the flexible annulus sealing element and isolate the producing reservoir; and conducting the fluid from the annulus above the flexible annulus sealing element to a location in which debris has accumulated to thereby mobilize the debris and permit the debris to be removed.

14. The method of claim 13 further comprising the step of continuing to pump fluid from surface into the wellbore annulus to circulate the debris back to surface through the production tubing.

15. The method of claim 14 further comprising the step of starting the downhole pump to aid in circulating the debris to surface and to resume production of fluids from the reservoir.

16. The method of claim 15 further comprising the step of allowing the fluid in the well annulus above the flexible annulus sealing element to drain at a controlled rate to the pump intake to dilute further influxes of debris.

17. The method of claim 16 further comprising the step of relaxing the flexible annulus sealing element to allow the upward flow of formation gas in the well annulus during normal pump operation.

18. The method of claim 13 in which the location in which debris has accumulated is at the pump intake.

19. The method of claim 18 in which the fluid is introduced to the pump intake only when pressure in the annulus above the flexible annulus sealing element is below a pre-set pressure.

20. The method of claim 13 in which the location in which debris has accumulated is within the production tubing string above the downhole pump.

21. The method of claim 20 in which the location in which debris has accumulated is within a tubular tool body forming part of the production tubing, the flexible annulus sealing element being attached to the tubular tool body.

* * * * *